US006066049A

United States Patent [19]

Milanian

[11] Patent Number: 6,066,049

[45] Date of Patent: May 23, 2000

[54] RE-ENACTMENT OF A DEEP-SEA VOYAGE TO THE BOTTOM OF THE SEA

[76] Inventor: Cyrus Milanian, 2070 SE. 16th St., Pompano Beach, Fla. 33062

[21] Appl. No.: 09/329,100

[22] Filed: Jun. 9, 1999

Related U.S. Application Data

[60] Provisional application No. 60/074,153, Feb. 9, 1998, abandoned.

[51] Int. Cl.[7] ..... A63G 3/00

[52] U.S. Cl. ..... 472/13; 472/128

[58] Field of Search ..... 472/13, 117, 128, 472/65, 66; 104/53, 70, 71, 83

[56] References Cited

U.S. PATENT DOCUMENTS

| | | | |
|---|---|---|---|
| 764,675 | 7/1904 | Pfeiffer | 472/13 |
| 883,441 | 3/1908 | Andrews | 472/13 |
| 3,114,333 | 12/1963 | Fowler et al. | 472/13 |
| 3,930,450 | 1/1976 | Symons | 104/71 |
| 5,215,016 | 6/1993 | Futami | 104/71 |
| 5,775,226 | 7/1998 | Futami et al. | 104/71 |

*Primary Examiner*—Kien T. Nguyen
*Attorney, Agent, or Firm*—Oltman, Flynn & Kubler

[57] ABSTRACT

The construction of one or more of conveyances i.e. "sub-marines" in the form of a sub-marine passenger vessel for the re-enactment of an underwater voyage to the bottom of the sea is disclosed herein. The vessels have seating for passengers seated along windows for watching a sub-marine landscape created on the lake bottom. The vessel has a degree of buoyancy and runs on a track, not visible to the passengers mounted on piers set on the lake bottom. It is propelled e.g. by an endless drag line. The vessel has windows allowing passengers to view numerous features on the lake bottom and in the water. The re-enactment of an under-water voyage to the bottom of the sea, includes a body of water having a bottom and a border area adjoining the body of water. At least one conveyance accessible to the passengers has viewing mechanism affording the passengers a view of features in the water and on the bottom of the lake, and conveying device cooperating with the conveyance for conveying passengers along a pre-arranged track disposed on at least part of the lake bottom and on the border area. The re-enactment may further include at least a structure disposed in the border area, having a likeness of an ocean liner, and/or wherein the structure has an ocean liner. The re-enactment may further include another structure disposed in the border area, the other structure having the likeness of a building. The re-enactment may additionally include a plurality of sea creatures in the body of water, wherein at least one of the sea creatures is a live sea creature and wherein further at least one of the sea creatures is an animated mechanical sea creature.

21 Claims, 4 Drawing Sheets

FIG. 10
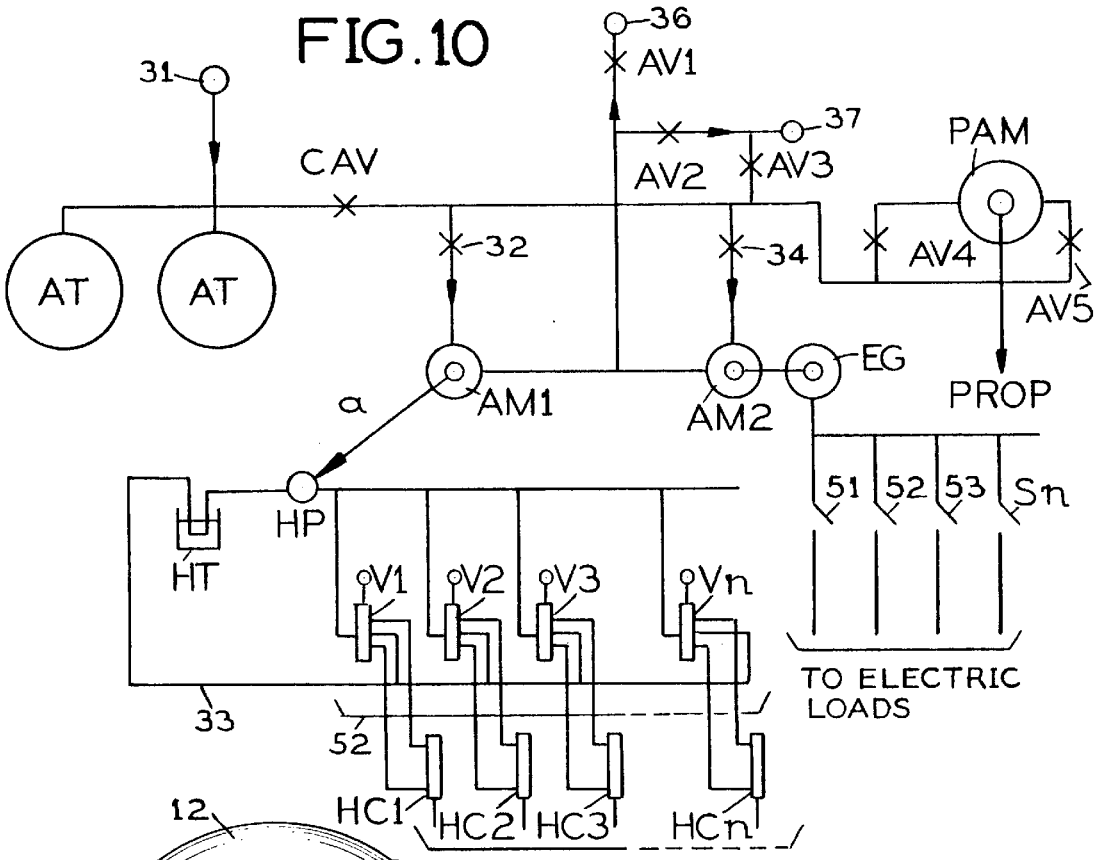
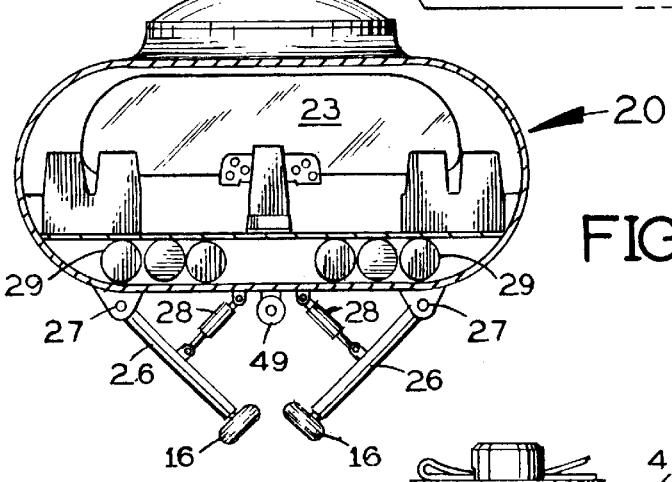
FIG. 7
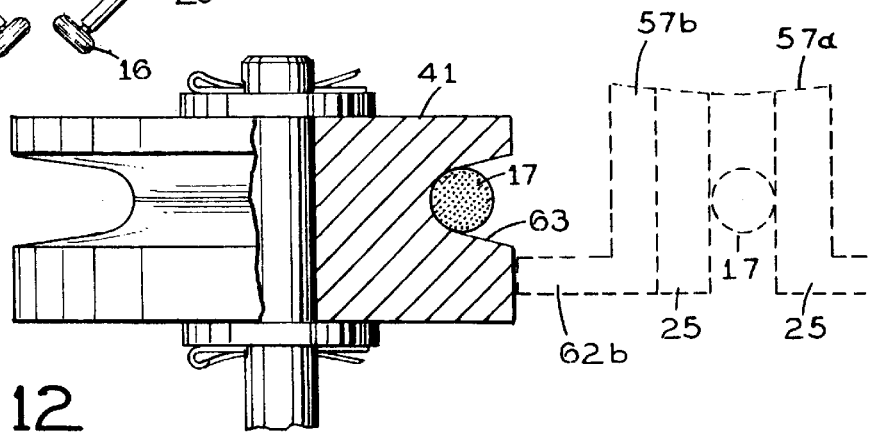
FIG. 12

RE-ENACTMENT OF A DEEP-SEA VOYAGE TO THE BOTTOM OF THE SEA

The invention relates to apparatus for re-enactment of a deep-sea voyage to the bottom of the sea. Reference is made to Provisional Patent Application Ser. No. 60/074,153 filed Feb. 9, 1998 and entitled "Titanic Complex: Casino, Hotel Resort and Theme Park." now abandoned.

BACKGROUND OF THE INVENTION

It is well known that the oceans and large bodies of water have always attracted the interest and curiosity of many people. In particular, oceans and deep-sea water bottoms have during the ages been a source of great interest and fantasies about deep-sea creatures.

The present invention builds on this interest and accordingly contemplates a re-enactment of a deep-sea voyage, accessible to the public by offering a re-enactment including a simulated voyage to a deep-sea ocean bottom.

The voyage accordingly seeks to provide both educational and entertaining features.

SUMMARY OF THE INVENTION

A body of water is considered to be available for the re-enactment. It should preferably be a fresh-water body, since ocean water is corrosive. A natural lake or a branch of a larger lake with natural water flow will be preferable. The construction of one or more of conveyances i.e. "submarines" in the form of a sub-marine passenger vessel for the re-enactment is disclosed herein. The vessels will have seating for passengers seated along windows for watching a submarine landscape created on the lake bottom.

The vessel will have a degree of buoyancy and run on a track, not visible to the passengers, mounted on piers set on the sea bottom. It will be propelled e.g. by an endless drag line in a manner somewhat similar to the system used by the cable cars of San Francisco.

The vessel will have windows allowing passengers to view numerous features on the sea bottom and in the water.

The re-enactment of an under-water voyage to the bottom of the sea, includes a body of water having a bottom and a border area adjoining the body of water;

At least one conveyance accessible to the passengers has viewing means affording the passengers a view of features in the water and on the bottom of the sea, and conveying means cooperating with the conveyance for conveying passengers along a pre-arranged track disposed on at least part of the sea bottom and on the border area, and wherein the body of water preferably includes fresh water.

The re-enactment means may further include at least a structure disposed in the border area, having a likeness of an ocean liner, and/or wherein the structure has an ocean liner, e.g. in a likeness of the ship Titanic.

The re-enactment means may further include another structure disposed in the border area, the other structure having the likeness of a building.

The re-enactment means may additionally include a plurality of sea creatures in the body of water, wherein at least one of the sea creatures is a live sea creature and wherein further at least one of the sea creatures is an animated mechanical sea creature.

The re-enactment means can further include an enclosure in the body of water for confining at least a part of the sea-creatures to a confined space within the body of water, and wherein in addition at least a part of the enclosure has transparent walls facing the conveyance means. The re-enactment means may additionally include a plurality of bottom features disposed on the bottom, wherein the bottom features include at least one of the features such as ship wrecks, bottom of an iceberg, oil wells, sea bottom nodules and hydrothermal vents.

As an additional feature, the conveyance means includes a hollow airtight transporter for transporting a plurality of persons inside the transporter, at least one opening for ingress and egress on the transporter of the persons, and airtight closing means for airtightly closing the opening, and wherein the viewing means include a plurality of transparent windows in the transporter, and wherein further the airtight transporter has coupling means for coupling the transporter to the conveyance means.

In addition, the coupling means may include disengagement means, operable from at least inside the transporter for disengaging the transporter from the conveyance means, and wherein further the disengagement means are operable from outside of the transporter.

The aforesaid transporter preferably has a shape substantially as an oblong cylinder, wherein the coupling means include two coupling points disposed underneath the cylinder, each coupling joint advantageously disposed substantially near or proximal to a respective end of the cylinder.

As a further feature, the conveying means includes a track fixedly attached to the bottom of the body of water.

The aforesaid track may include a plurality of anchor points disposed along the track, each anchor point being fixedly attached at one side to the lake bottom, and at another side to the track, and wherein the conveyance means includes a drag line running substantially parallel with the track, and a drag device fixedly attached at one side to the one location of the transporter, and to another side being detachably attached to the drag line. Furthermore, the drag device includes internal disconnecting means disposed inside the transporter for internally disconnecting the transporter from the drag line, in case a need for allowing the transporter to rise to the surface should occur.

In accordance with an additional feature, a pilot station is provided inside the transporter, the pilot station having selective disconnecting means for selectively disconnecting the transporter from at least one of the track and the drag line.

According to an additional feature, the invention may include a starting ramp for the conveyance, disposed on the border area for imparting to the conveyance a given entrance speed before entering the body of water.

As still another feature, the starting ramp includes a lower part having a curved track section, imparting to the conveyance a non-linear path of motion before entering the body of water; and as an additional feature a part of the curved track, a non-linear path shaped as a spiral.

Further objects and advantages of this invention will be apparent from the following detailed description of a presently preferred embodiment, shown schematically in the accompanying drawings.

BRIEF DESCRIPTION OF THE FIGURES OF THE DRAWINGS

FIG. 7 is a cross-section through the transporter seen along the line 7—7 of FIG. 2;

FIG. 10 is a circuit diagram of the electrical and hydraulic system of the transporter.

FIG. 12 is a partial cross-section of an idler wheel supporting the drag line.

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENTS

Figure 1:
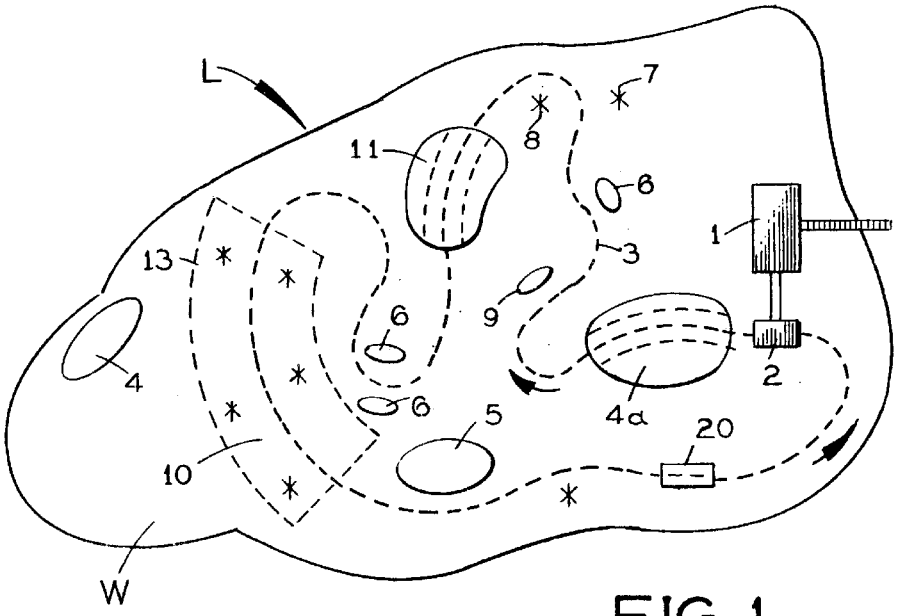
FIG. 1 is a top-down plan view of the major elements of the invention and its operating environment.

FIG. 1 shows an outline of a body of preferably fresh water forming a lake 1L as contemplated for a location of the invention, having a track 3, shown as a dashed line, which winds its way around a number of features in the water and on the sea bottom.

An assembly and ticket building I is connected with an embarking and de-embarking station 2, where the submarines i.e. vessels 20, come to the surface. Arrows show the direction of the vessels.

At 4 there is a land based structure having a likeness of an ocean liner, e.g. the liner "Titanic," which can be a hotel, museum or the like.

The first feature shown 4*a*, is a large cage or transparent enclosure holding numerous live fish and having a tunnel through which the vessel 20 "sails" letting the passengers see a large variety of exotic fish and other sea creatures. Along the track 3 there are numerous attractions, such as wrecks 6 of sunken ships, sea "monsters" such as an animated giant octopus, squids, sharks and "pirate treasures". At 11 the vessel goes through an underwater "cave" where spotlights on the vessel point to sights such as "glowing" underwater volcanoes, sleeping sharks, giant clams and so forth.

From there the vessel goes deeper to an area 10 which is completely dark due to a cover 13 above that blacks out all daylight. There the sea bottom has deep-sea hot-water vents with many forms of sea-life only found there, and deep-sea creatures.

The vessel may pass by an underwater "habitat" 5 where researchers study deep-water fauna and the like.

At 5, the vessel passes under or beneath the bottom of an "iceberg", which is internally illuminated with blue lights to effectively emulate the look of a real mass of ice. The "bottom" of the iceberg would be formed of e.g. sheets of acrylic or similar durable plastic.

Figure 2:
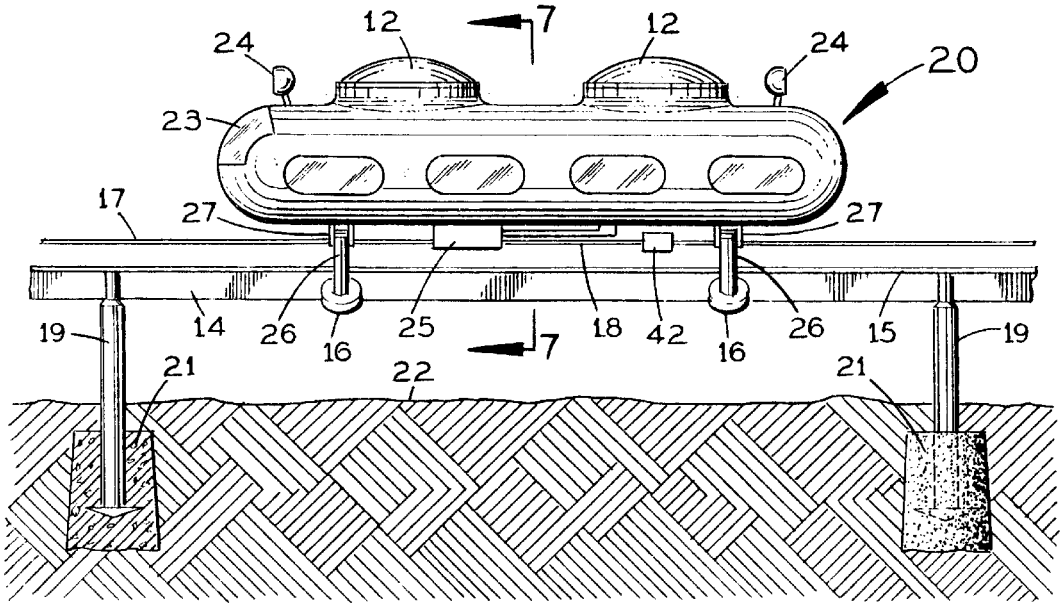
FIG. 2 is an elevational view of the person transporter in submerged condition and part of drive and control apparatus for the transporter.
Figure 3:
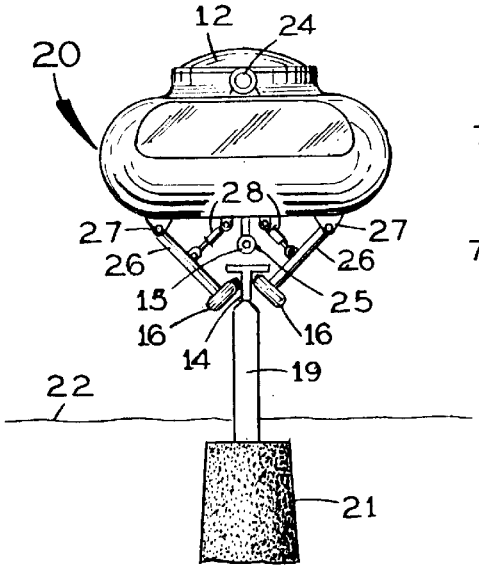
FIG. 3 is a front elevation of the submerged person transporter and parts of the drive and steering apparatus.
Figure 6:
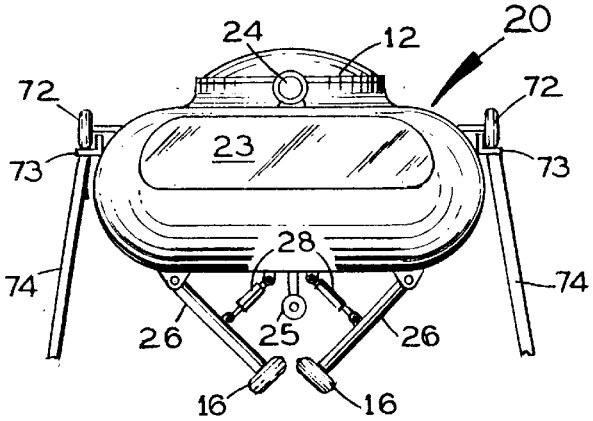
FIG. 6 is a front elevation of the person transporter positioned on the starting ramp.

FIGS. 2 and 3 are respective side and front views of the vessel 20. As mentioned above, it emulates a freely floating fantasy deep sea vessel, but is for practical reasons floating above a guide track 15, which winds its way through the body of water along the path indicated by the dashed line 3 in FIG. 1.

The vessel 20 has internal seating for a given number of passengers who can view the features of the sea voyage through windows 13 while listening to a narrative of the "sea voyage". Two hatches 12 allow quick entry and exit from the vessel. The vessel 20 is guided and restrained by a T-shaped track 14 to which it is restrained by rubber rimmed wheels 16, which provide a noiseless, quiet ride through the water. The vessel is propelled by a continuously running cable 17 driven from a central power station 43, Fig 11. A clutch 25 on a pivoting arm 18 can be engaged and disengaged from the interior of the vessel by its pilot, who has a seat up front behind a curved windshield 23. The pilot or a helper have access to one or two spotlights 24 which can be trained on any outside object during the voyage to point out certain features of interest.

For safety reasons, the vessel has some degree of buoyancy, even when fully loaded, and can, in case of an emergency, be quickly released from the track 14 by means of a swing-out arrangement for the wheels 16, seen in FIG. 3, which allows the vessel to safely rise to the surface.

The track 14 is attached to the sea bottom 22 by means of columns 19, each secured to a pier 21 firmly secured in the sea bottom.

FIG. 3 shows in a front view further details of the vessel 20 and the track 14, which is "T"-shaped with a top flange 15. The wheels 16 are mounted on swing-out shafts 26, that are attached by hinges 27 to the vessel 20.

Two hydraulic cylinders 28 are connected between the vessel 20 and the shafts 26, and serve to swing the wheels 16 out and away from a top flange 15 of the track 14, so that vessel 20 can completely disengage from the track 14. Since the vessel is buoyant, even when fully loaded, it will rise to the surface when necessary, e.g. in an emergency or if the vessel has to removed from the track for service, etc. The hydraulic cylinders 28 are operated in conventional manner from the pilot station inside the vessel. It follows that the vessel 20, when occupied by people, must have a supply of fresh air for breathing. For that purpose one or several compressed air cylinders 29. seen in FIG. 7, are placed low in the vessel 20, as shown in FIG. 7, which shows diagrammatically a cross-section through the vessel, seen along the stippled line 7—7 of FIG. 2.

Additional ballast may be required, depending on the weight of the vessel 20 when loaded, which if necessary could be attached externally on the vessel, but not shown in the figure.

The additional ballast may be arranged to be disconnectable from the vessel if desired to lighten the vessel.

The compressed air serves the further purpose of providing a source of energy required for the vessel. As examples, the vessel's operation requires hydraulic power for a number of control functions and electric energy for internal illumination during certain phases of the "voyage". Furthermore, cabin air pressure may be used to prevent inflow of water, should a minor leak occur during submerged operation. Generation of electricity be means of air pressure will prevent the need for carrying storage batteries in the vessel, which require maintenance and recharging, and may produce poisonous gases if exposed to water.

FIG. 10 shows a general circuit control diagram for the vessel. A number of compressed air tanks AT are charged with compressed air at air inlet 31. An air motor AM1, under control of manually operated air valve 32 drives via coupling "a" a hydraulic pump HP, having a hydraulic fluid intake from a hydraulic fluid tank HT. The outlet of the hydraulic pump HP is connected to a number of manually operated hydraulic control valves V1,V2 and V3. These valves are of the proportional control valve type, which are per se well known and widely used in hydraulic control systems. leach hydraulic valve Vn is connected to a respective one of hydraulic cylinders HC1, HC2 and HC3. Lach hydraulic cylinder has a specific function as described in more detail below. There may be additional hydraulic cylinders having other functions, not specifically addressed in this disclosure. Each control valve Vn has a fluid return line 33 returning fluid to the hydraulic fluid tank HT. Another air motor AM2 is controlled by an air valve 34 controlling air input to air motor AM2, driving an electric generator EG, which provides electric power via electric switches S1 . . . Sn to a number of electric loads, such as internal cabin lights, external spotlights, internal signs, etc. to be provided according to their specific need.

The used air from the air motors AM1, AM2, can be vented to the outside via outside air vent 36, or to an inside air vent 37, if the spent air is needed internally in the vessel for supplying passengers with breathing air. Air to vents 36,37 is controlled by air valves AV1, AV2. A third air valve AV3 provides internal breathing air directly from air tanks AT.

In order to maintain constant air output pressure, an automatic air pressure control valve CAV is arranged to automatically provide constant air pressure to all compressed air loads within the cabin.

Various propulsion systems for the vessels are being contemplated. One such system includes a propulsion air motor PAM, FIG. 10, which drives a set of friction rollers 42 in contact with the drag line 17, or directly connected with one or both pairs of wheels 16, or the friction roller may be in contact with the track 14,15. This system has the advantage that each vessel can move forward or in reverse or stop completely under control of the pilot. The air drive system has the drawback that the drive distance is limited to the amount of compressed air available to the vessel. Air supply stations could be placed at certain points along the track in order to increase the distance. The air drive system has the advantage that the track can be of much lighter construction. It could for example be reduced to a stationary drag line.

Figure 11:
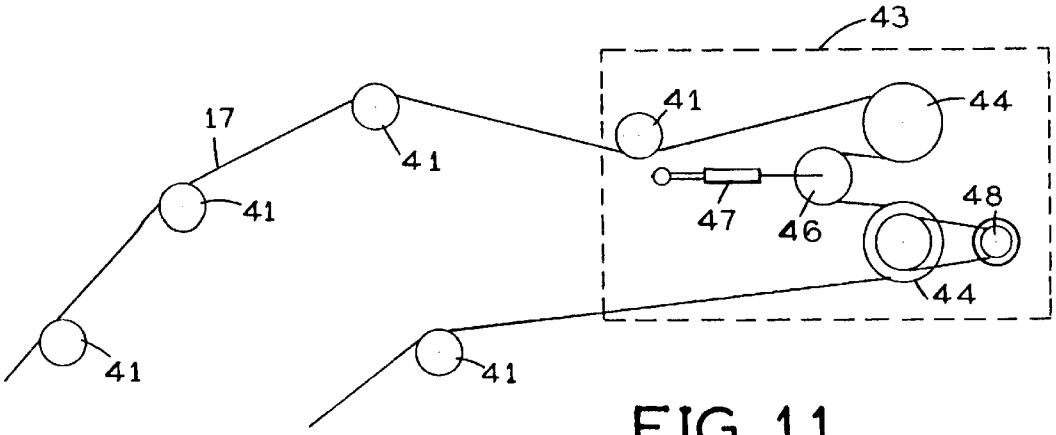
FIG. 11 is a diagrammatic view of the drag line as positioned on a lake bottom.

Another propulsion method is based on a continuously running endless drag line driven from a fixed drive location 43, FIG. 11. Such a system is known from the cable cars in San-Francisco, Calif., which has been in operation for many years. Such a system is shown in diagrammatic form in FIG. 11 wherein the endless drag line 17 runs past idling rollers 41, which are placed underwater along the track; each one preferably placed on one of the anchors 19. The idling rollers 41, in the following simply called "rollers", must, it follows, be placed on the side of the drag line such that the line stays in a groove in the roller, and the entire line must be maintained under moderate amount of tension, so that the line stays in the groove. FIG. 2 shows a set of friction rollers 42 extending downward from the bottom of the vessel.

In FIG. 11 a drag line tensioning system is shown inside the dashed line box 43. wherein the line 17 runs past two or more larger wheels 44 and a smaller idler wheel 46 maintained under tension by a spring force or by a hydraulic cylinder 47 supplied with hydraulic pressure, sufficient to keep the drag line under tension. A large motor 48 drives one of the wheels 44 to keep the drag line moving, in case the system of a moving drag line is used for propulsion.

In still another propulsion method, each vessel is propelled by a ship's propeller located at the stern of the vessel. The propeller may be driven by a compressed air motor or by an electric motor driven by storage batteries in the vessel.

Figure 8:
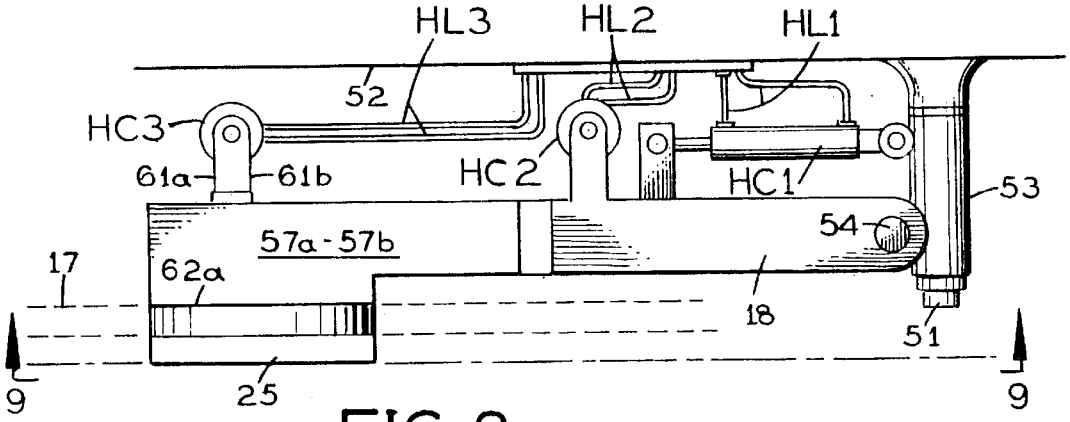
FIG. 8 is a side elevation of a clutch arranged to grab the drag line for forward propulsion of the transporter.
Figure 9:
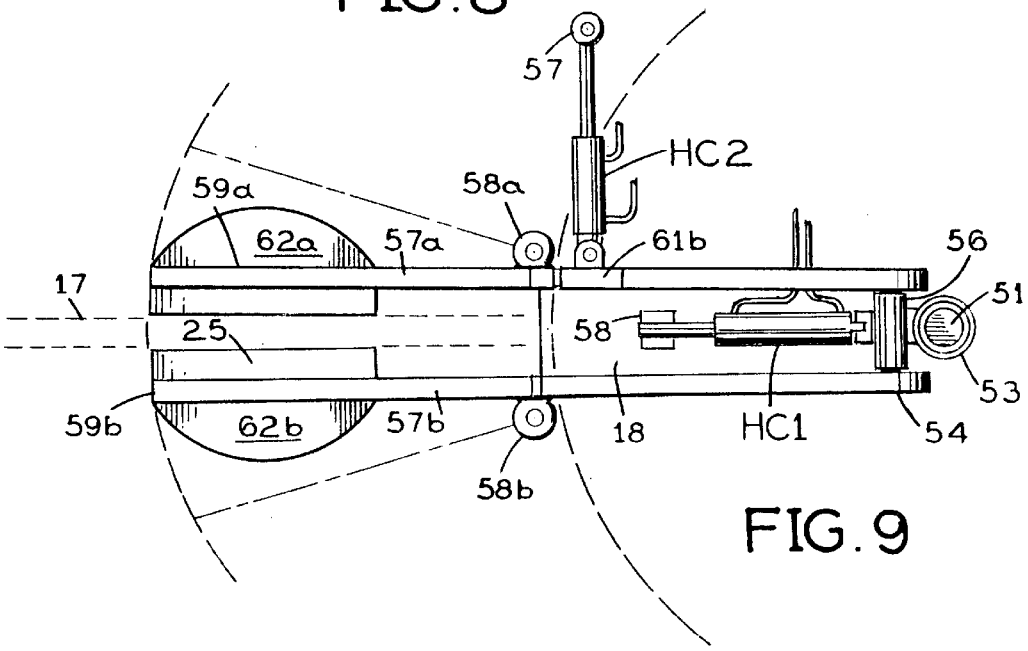
FIG. 9 is a bottom-up view of the clutch seen along the line 9—9 of FIG. 8.

FIGS. 8 and 9 show a respective side view and bottom-up view of the drag line clutch 25, seen along the line 9—9 of FIG. 8 of a cable clutch, as presently contemplated for connecting the vessel to either a moving drag line or a stationary drag line.

In case of a moving drag line, the clutch 18 has two jaws 25 that firmly clamp into the line 17 in order to drag the vessel along. In case of a stationary drag line, the jaws 25 form, when closed, an opening 49, FIG. 3, through which the line can slide as the vessel is propelled along by the friction rollers 42 driving the vessel, or directly by rollers 16.

The clutch shown in FIGS. 8 and 9 include a clutch arm 18 attached by a universal linkage to a stud 51 attached to the bottom 52 of the vessel. A collar 53 is rotatably attached to the stud 51. The clutch arm 18 is pivotable in vertical direction about a pivot pin 54 disposed inside a second collar 56, attached to first collar 51 at right angles thereto, as seen in FIG. 9. The clutch 18 is pivotable in horizontal and vertical direction under control of respective hydraulic cylinders HC2 and HC1, each cylinder being anchored at respective pivotable anchor points 57, 58. The clutch arm 18 is extended into respective extension arms 57*a* and 57*b* via respective hinges 58*a* and 58*b*. The distal ends 59*a* and 59*b* are connected via respective brackets 61*a* and 61*b* to opposite ends of a hydraulic cylinder HC3. The hydraulic cylinders HC1 and HC2 serve to manipulate to clutch arm 18 from inside the vessel, so that two clutch pads 25 can be brought in contact with drag line 17. After contact is made, hydraulic cylinder HC3 is operated to clamp clutch pads 25 firmly onto the drag line 17. Each hydraulic cylinder is operated via respective pairs of hydraulic lines HL1, HL2 and HL3, each pair of lines communicating with respective control valves V1,V2 and V3, shown in FIG. 10.

Each extension arm 57*a*, 57*b* has an outwardly curved deflecting fin 62*a*, 62*b*. These fins serve the purpose of preventing the drag line 17 from becoming disconnected from the idler roller 41 as the vessel passes one of these rollers. An idler roller 41 is shown in larger scale in FIG. 12. In particular, one of he fins 62*b* and 62*a* is shown in phantom lines, attached to the extension arms 57*a*, 57*b*, as the vessel passes an idler roller 41. At that time the drag line 17, being clamped between the pads 25, is moved out of its groove 63 in the roller 41 and placed back in the roller when the vessel continues on its course.

Figure 4:
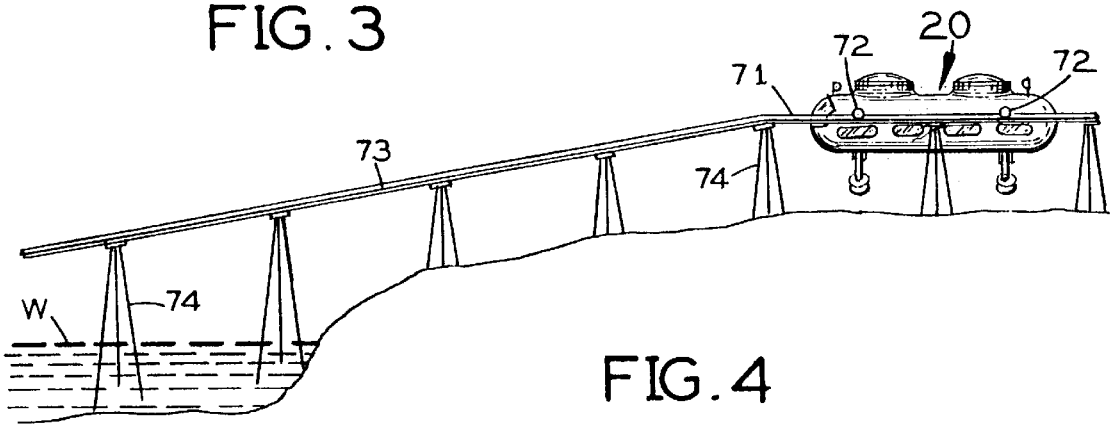
FIG. 4 is an extended application of the invention, including a starting ramp for the person transporter.
Figure 5:
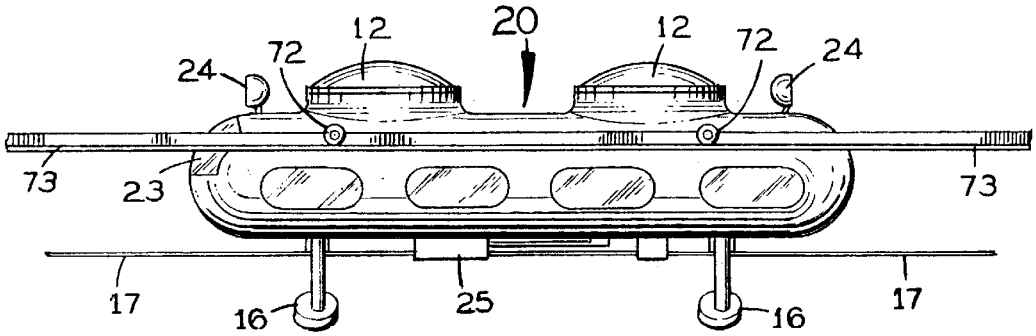
FIG. 5 is a side elevation of the person transporter positioned on the starting ramp.

As an added feature of the underwater voyage seen in FIG. 4, a starting ramp 71 for the transporter 20 may be provided above the water to impart to the transporter an initial above water starting speed, which creates a significant magnitude of splash as the transporter 20 enters the water. To that end, the transporter 20 is to be equipped with above center of gravity wheels 72, which run in respective "L"-shaped tracks 73 mounted on the ramp 71. The ramp 71 is supported above water on pillars or columns 74. For additional effect, the tracks 73 may be non-linear, i.e. curved in both horizontal and vertical dimensions, and even in circular shape for imparting to the ride an additional degree of thrill to the ride.

I claim:

1. Re-enactment means of an under-water voyage to the bottom of the sea comprising a body of water having a bottom and a border area adjoining said body of water;

at least one conveyance for persons, having viewing means affording the public view of features in the water and on said bottom of said body of water;

and conveying means cooperating with said conveyance for conveying the persons along a pre-arranged track disposed on at least part of said bottom of said body of water and on said border area;

wherein said conveyance includes a hollow airtight transporter for tramsporting the persons inside said transport, at least one opening for ingress and egress on said transpoter of said persons, and airtight closing means for airtightly closing said opening, and wherein said viewing means include a plurality of transparent windows in said transporter;

wherein said airtight transporter has coupling means for coupling said transporter to said conveyance means; and wherein said coupling means include disengagement means, operable from at least inside said transporter for disengaging said transporter from said conveyance means.

2. Re-enactment means according to claim 1, wherein said body of water contains fresh water.

3. Re-enactment means according to claim 1 including at least a structure disposed in said border area, said structure having a likeness of an ocean liner.

4. Re-enactment means according to claim 3, wherein said structure has a likeness of the ship Titanic.

5. Re-enactment means according to claim 3, including another structure disposed in said border area, said other structure having the likeness of a building.

6. Re-enactment means according to claim 1, including a plurality of sea creatures in said body of water, wherein at least one of said sea creatures is a live sea creature.

7. Re-enactment means according to claim 6, wherein at least one of said sea creatures is an animated mechanical sea creature.

8. Re-enactment means according to claim 6, including an enclosure in said body of water for confining at least a part of said sea-creatures to a confined space within said body of water.

9. Re-enactment means according to claim 8, wherein at least a part of said enclosure has transparent walls facing said conveyance means.

10. Re-enactment means according to claim 1, comprising a plurality of bottom features disposed on said bottom, wherein said bottom features include at least one of the features from the group of features comprising ocean ridges and troughs, volcanic holes, sunken submarines, bottom of an iceberg, oil wells, sea bottom nodules and hydrothermal vents.

11. Re-enactment means according to claim 1, wherein said disengagement means are operable from outside of said transporter.

12. Re-enactment means according to claim 11, wherein said transporter has a shape substantially as an oblong cylinder, wherein said coupling means include two coupling points disposed underneath said cylinder, each coupling point disposed substantially proximal to a respective end of said cylinder.

13. Re-enactment means according to claim 1, wherein said conveying means includes a track fixedly attached to said bottom.

14. Re-enactment means according to claim 13, wherein said track includes a plurality of anchor points disposed along said track, each anchor point being fixedly attached at one side to said bottom, and at another side to said track.

15. Re-enactment means according to claim 14, wherein said conveyance means includes a drag line running substantially parallel with said track, and a drag device fixedly attached at one side to said transporter, and to another side detachably attached to said drag line.

16. Re-enactment means according to claim 15, wherein said drag device includes internal disconnecting means disposed inside said transporter for internally disconnecting said transporter from said drag line.

17. Re-enactment means according to claim 1, including a pilot station inside said transporter, said pilot station having selective disconnecting means for selectively disconnecting said transporter from at least one of said track and said drag line.

18. Re-enactment means as in claim 1, further including a starting ramp connected with said conveyance, disposed on said border area for imparting to said conveyance a given entrance speed before entering said body of water.

19. Re-enactment means as in claim 18, wherein said starting ramp is non-linear.

20. Re-enactment means as in claim 19, wherein said ramp is non-linear in at least two-dimensions.

21. Re-enactment means as in claim 20, wherein said ramp includes a pair of rails, and said transporter includes a set of wheels cooperating with said rails for steering said transporter along said rails.

* * * * *